US009567713B2

(12) United States Patent
Perrin et al.

(10) Patent No.: US 9,567,713 B2
(45) Date of Patent: Feb. 14, 2017

(54) METHOD OF PRODUCING DECORATIVE PAPER AND DECORATIVE LAMINATE COMPRISING SUCH DECORATIVE PAPER

(75) Inventors: Claude Perrin, Charavines (FR); Cyril Blois, Epinal (FR)

(73) Assignee: MUNKSJO ARCHES, Arches (FR)

( * ) Notice: Subject to any disclaimer, the term of this patent is extended or adjusted under 35 U.S.C. 154(b) by 1325 days.

(21) Appl. No.: 11/569,047

(22) PCT Filed: May 13, 2005

(86) PCT No.: PCT/FR2005/001203

§ 371 (c)(1),
(2), (4) Date: Jan. 18, 2007

(87) PCT Pub. No.: WO2005/116337

PCT Pub. Date: Dec. 8, 2005

(65) Prior Publication Data

US 2008/0090032 A1 Apr. 17, 2008

(30) Foreign Application Priority Data

May 13, 2004 (FR) ..... 04 05205

(51) Int. Cl.

| | |
|---|---|
| ***D21H 27/26*** | (2006.01) |
| ***B44C 5/04*** | (2006.01) |
| ***D21H 23/48*** | (2006.01) |
| ***B41M 7/00*** | (2006.01) |
| *B41M 5/52* | (2006.01) |
| *D21H 19/40* | (2006.01) |
| *D21H 19/60* | (2006.01) |
| *D21H 23/70* | (2006.01) |

(52) U.S. Cl.

CPC ..... *D21H 27/26* (2013.01); *B41M 7/0027* (2013.01); *B44C 5/04* (2013.01); *D21H 23/48* (2013.01); *B41M 5/5218* (2013.01); *B41M 5/5254* (2013.01); *D21H 19/40* (2013.01); *D21H 19/60* (2013.01); *D21H 23/70* (2013.01)

(58) Field of Classification Search

USPC ..... 427/261

See application file for complete search history.

(56) References Cited

U.S. PATENT DOCUMENTS

| | | | | |
|---|---|---|---|---|
| 4,532,157 | A * | 7/1985 | Schmidt et al. | 427/262 |
| 4,732,786 | A * | 3/1988 | Patterson et al. | 427/261 |
| 5,429,860 | A * | 7/1995 | Held et al. | 428/32.3 |
| 5,521,002 | A * | 5/1996 | Sneed | 428/331 |
| 5,773,093 | A | 6/1998 | Mitani et al. | |
| 6,287,681 | B1 | 9/2001 | Mehta et al. | |
| 6,512,674 | B1 | 1/2003 | Tozawa | |
| 6,517,674 | B1 | 2/2003 | Das | |
| 6,706,372 | B2 | 3/2004 | Schulz | |
| 2001/0012556 | A1 * | 8/2001 | Kondo et al. | 428/195 |
| 2002/0048654 | A1 * | 4/2002 | Yoshino et al. | 428/195 |
| 2002/0117277 | A1 | 8/2002 | Johnson et al. | |
| 2003/0039810 | A1 * | 2/2003 | Schulz et al. | 428/195 |
| 2003/0072925 | A1 * | 4/2003 | Kiyama et al. | 428/195 |
| 2003/0113520 | A1 * | 6/2003 | Takahashi et al. | 428/201 |
| 2005/0165135 | A1 * | 7/2005 | Mozel et al. | 523/440 |

FOREIGN PATENT DOCUMENTS

| | | | |
|---|---|---|---|
| CN | 1361839 | A | 7/2002 |
| EP | 0 054 405 | A | 6/1982 |
| EP | 1 044 822 | A | 10/2000 |
| EP | 1 044 822 | A1 | 10/2000 |
| EP | 1044822 | B1 | 9/2004 |
| FR | 2 734 203 | A | 11/1996 |
| JP | 6-183132 | A | 7/1994 |
| JP | 10 114142 | A | 5/1998 |
| JP | 10-264596 | A | 10/1998 |
| JP | 2002 274009 | A | 9/2002 |
| JP | 03 353925 | B2 | 12/2002 |
| WO | 00/22232 | A | 4/2000 |

OTHER PUBLICATIONS

Chinese Office Action dated Jan. 23, 2009, issued in corresponding Chinese Patent Application No. 2005-800151621.

International Search Report of PCT/FR2005/001203, date of mailing Sep. 30, 2005.

Mendez, B. et al.; "Curtain Coating—Ein neuartiges Auftragsverfahren zum Streichen mit hochster Prazision" Wochenblatt fur Papierfabrikation 22-2001; pp. 1492-1497. (cited in Notification of Opposition (Non-Pat Lit 2)).

Notification of Opposition dated Jun. 8, 2010, issued in corresponding European Patent Office (EPO) Application No. 05771104.6.

Opposition Letter dated Jul. 8, 2010, issued in corresponding European Patent Office (EPO) Application No. 05771104.6.

Response of patent owner dated Dec. 24, 2010 in opposition in counterpart EP 1749134; with English machine-translation.

Communication by Opponent dated Oct. 24, 2011 in opposition in counterpart EP 1749134; with English machine-translation.

Decision by EPO dated Jan. 20, 2012 rejecting the opposition in counterpart EP 1749134; with English machine-translation.

Opponent Appeal dated May 30, 2012 in opposition in counterpart EP 1749134; with English machine-translation.

Applicant letter to EPO dated Jul. 29, 2003 in examination of EP 1044822B2, cited in Response of patent owner in opposition in counterpart EP 1749134; with partial English translation.

"Plastic Laminates Symposium Aug. 17-20, 1998", TAPPI Press, Atlanta, GA (1998), cited in Response of patent owner in opposition in counterpart EP 1749134.

Cohen et al., "Coating Processes Survey", in Kirk-Othmer Encyclopedia of Chemical Technology, Wiley Online Library, Published online, Apr. 19, 2002.

Canada Patent Office Office Action dated Jul. 3, 2012 in examination of counterpart CA 2,564,505; with English machine-translation.

* cited by examiner

*Primary Examiner* — Xiao Zhao

(74) *Attorney, Agent, or Firm* — Westerman, Hattori, Daniels & Adrian, LLP

(57) ABSTRACT

The invention relates to a method of producing decorative paper which is coated with at least one ink-fixing layer, which is printable and which can be impregnated with a thermosetting resin, in order to produce a high- or low-pressure decorative laminate. The inventive method comprises the following steps consisting in: (a) producing a base sheet of decorative paper using paper-making means; and (b) coating at least one of the faces of the base paper sheet with said at least one ink-fixing layer, by means of curtain coating. The invention also relates to high- or low-pressure decorative laminates comprising such decorative paper.

17 Claims, No Drawings

METHOD OF PRODUCING DECORATIVE PAPER AND DECORATIVE LAMINATE COMPRISING SUCH DECORATIVE PAPER

BACKGROUND ART

The invention relates to a process for producing a decorative paper that can be impregnated with a thermosetting resin, having at the same time good printability, in particular for ink jet printing, and good resin-absorption properties. The invention also relates to such a decorative paper impregnated with a thermosetting resin. The invention finally relates to laminated decorative panels or profiles comprising the decorative paper impregnated with thermosetting resin.

Laminated decorative panels or profiles (also called "laminates") have been employed for many years in dwellings and commercial and industrial premises. Typical applications for such laminates are floor coverings, in particular coverings imitating parquet flooring, furniture coverings, tabletops, chairs and the like.

Two main types of decorative "laminates" exist: "laminates" called high-pressure laminates and "laminates" called low-pressure laminates.

Decorative laminates called high-pressure laminates are produced from a core consisting of sheets impregnated with resin. These sheets are generally made of kraft paper and have been impregnated with a thermosetting resin, most often a phenolic resin. After having impregnated the sheets with resin, they are dried, cut up and then stacked one on top of another. The number of sheets in the stack depends on the applications and varies between 3 and 9, but may be higher. A decorative paper, also called a decor paper or decorative sheet is then placed on the stack of sheets forming the core. Such a decorative sheet is generally a sheet of paper bearing a printed or colour pattern or containing decorative particles, and it is impregnated with a thermosetting resin, for example melamine-formaldehyde resins, urea-formaldehyde resins, benzoguanamine-formaldehyde resins or unsaturated polyester resins.

In general, a protective covering sheet, called an "overlay" that has no pattern and is transparent in the final laminate, is placed on top of said decorative sheet, in order to improve the abrasion resistance of the laminate.

The stack of impregnated sheets is then placed in a laminating press, the platens of which are provided with a metal sheet giving the laminate the surface finish. The stack is then densified by heating, at a temperature of about 110° C. to 170° C., and by pressing, with a pressure of about 5.5 MPa to 11 Mpa, for approximately 25 to 60 minutes in order to obtain a unitary structure. Next, this structure is fixed to a base support, for example it is adhesively bonded to a panel of agglomerated particles, in particular agglomerated wood particles.

Decorative laminates known as low-pressure laminates are produced using only one decorative sheet impregnated with thermosetting resin, and optionally an overlay sheet, which is laminated directly onto the base support during a short cycle, the temperature being of about 160° C. to 175° C. and the pressure 1.25 MPa to 3 MPa.

The decorative paper or decorative sheet used for producing laminates is generally a paper sheet made on a paper machine. Currently marketed decorative papers are generally free from surface treatment so as in particular not to harm their impregnation speed.

These decorative papers or decorative sheets are generally used to give a special esthetic appearance to the laminated supports on which they are fixed, it being possible for this esthetic appearance to result from printing the paper with a decorative pattern.

But, this decorative pattern, which traditionally consisted in imitating the aspect of a natural material such as wood or marble, has taken many more diverse forms taking account of the demand, so as to be adapted to the customer's requirements and wishes. This increase in the variety of patterns has been on the other hand accompanied by a reduction in the quantities to be produced.

This phenomenon of the personalization of decorations and of short production runs has not been without consequences for decorative paper producers. Indeed, for the mass production of simple patterns, printing techniques such as photogravure have the advantage of printing wide web at high production rates. However, this printing method does not prove to be profitable for small production runs and moreover the printing reproduction obtained is not satisfactory for complex patterns which require high resolution.

Among the printing techniques that are sufficiently flexible for the production of small quantities on demand, ink jet printing has proved to be the technique most suited to the requirements for decor papers. Apart from the simplicity of its operating principle and relatively low production costs, ink jet printing also makes it possible to obtain better quality printing. However, use of the principle of ink jet printing in the production of decor papers remains confronted with a major difficulty associated with the method for obtaining the laminates themselves.

In the conventional process for producing laminates, the decor paper is first of all printed and then impregnated with resin and finally hot-pressed with its support at a high or low pressure. The impregnation step requires the availability of a decorative paper having a high wet strength, so as to preserve a sufficient strength after its total immersion in an aqueous resin, as well as the greatest possible capacity to absorb resin in the shortest possible time. These properties are generally obtained by using decorative papers possessing very high porosity.

But, the technique of ink jet printing rests on the principle of fixing ink to the surface of the substrate to be printed, the substrate to be printed must therefore have limited absorption so as to obtain a clear and high quality printing.

Decorative papers improved by previously coating the decor paper with a layer comprising particles for fixing the ink, have already been described. These layers are often composed of a mixture of inorganic pigments, such as calcium carbonate, kaolin, silica, and a binder of the starch, casein, latex, polyvinyl alcohol or aminoplast resin type.

Patent application EP-A-054405 relates to the improvement of the printability of decorative papers, however ink jet printing is not specifically mentioned. This document describes papers coated with a pigmented layer conventionally known in printing-writing, but in order to maintain some capacity of the paper to absorb resin, the coating weight should not exceed 10 g/m$^2$ and the recommended weight lies between 2.5 and 3 g/m$^2$.

Patent application EP-A-1044822 describes a decorative sheet called a finished sheet, that can be ink jet printed, formed of a paper coated with an ink-fixing layer. Said paper must be previously smoothed on one face before being coated with said ink-fixing layer. This finished sheet is then bonded with adhesive onto a panel in order to make a decorative panel. This type of pre-impregnated paper is not intended for laminates called high- or low-pressure laminates. Moreover, the paper is pre-impregnated before being coated with the ink-fixing layer, there is therefore no problem with impregnation.

Although the printing reproduction of decorative papers is appreciably improved, many disadvantages remain associated with their production method, and in particular with coating techniques.

A first disadvantage associated with the blade coating technique is that the excess of coating to be applied before scraping and the mechanical stresses of pressure and tension during contact are difficult to apply to porous fragile papers such as decor papers. This coating technique brings about many breakages during production. A second disadvantage is that the actual coating technique by contact leads to partial penetration of the coating into the paper substrate and consequently a high degradation of the capacity of the paper to absorb resin.

As the prior art reveals, production of decorative paper having a relatively high coating weight and/or preserving a high absorption capacity for producing high- or low-pressure laminates, presents many difficulties.

SUMMARY OF INVENTION

The invention aims to solve the prior art problems of the decorative papers for laminates by providing a production process imparting to said decorative papers at the same time good printability, in particular, for ink jet printing, and good thermosetting-resin-absorption properties.

The object of the invention is to provide a process for producing a decorative paper that can be printed, in particular by ink jet printing, and that can be impregnated with a thermosetting resin, in order to obtain a printable decorative paper that can be impregnated with a resin at a high impregnation speed, determined according to the test described hereinafter in the paragraph "DESCRIPTION OF TESTS AND CONDITIONS FOR PERFORMING SAME", of less than 100 seconds, whatever its face, and that can be used to produce decorative laminates called high- or low-pressure laminates.

The object of the invention is therefore a process for producing a decorative paper coated with at least one ink-fixing layer, printable and that can be impregnated with a thermosetting resin, for a high- or low-pressure decorative laminate, comprising the following steps;

a. a sheet of base decor paper is produced by paper making route, then b. at least one of the faces of said sheet of base decor paper is coated by curtain coating with at least said ink-fixing layer.

According to the process of the invention for producing decorative paper, in a first step, a sheet of base decor paper is produced by paper making route on a paper machine from a dispersion based on cellulose fibers, and optionally synthetic fibers, in an aqueous medium, the cellulose fibers generally having a distribution by weight of 40 to 100%, preferably 80 to 100% of short fibers and 0 to 60%, preferably 0 to 20%, of long fibers. The dispersion preferably includes 0.2 to 2.5%, more preferably 0.4 to 0.8%, by dry weight based on the weight of the sheet, of a wet strength agent. The dispersion may also include 5 to 50% by dry weight based on the sheet, of decorative particles such as iridescent pigments, for example, pigmentary or organic dyes or of opacifying fillers such as titanium dioxide, in particular of the rutile type, said opacifying filler such as titanium oxide being generally in a quantity preferably of at least 15%, lying between approximately 15 and 40% based on the weight of the sheet.

According to the process of the invention, in a second step, at least one ink-fixing layer is applied by curtain coating to at least one of the faces of the sheet of base decor paper.

According to the invention, the sheet of base decor paper can be smoothed or not smoothed before being coated with the ink-fixing layer. Indeed, the process of the invention for producing decorative paper presents the advantage of producing a decor paper having final properties that are similar whatever the smoothness of the base paper. In particular, the sheet of base decor paper can have a Bekk smoothness of about 10 to 200 seconds.

Said ink-fixing layer preferably includes at least one hydrophilic binder, in particular a PVA (polyvinyl alcohol). According to a particular case of the invention, said layer includes in addition to said hydrophilic binder, a non-hydrophilic polymer binder in a ratio of hydrophilic binder/non-hydrophilic binder of at least 70/30 by dry weight. The non-hydrophilic binders are polymers used in stabilized aqueous dispersions (latex) that are usual in ink-fixing layers or in the paper-making field.

Preferably, the ink-fixing layer according to the invention is not alkaline so as not to impede the crosslinking of the thermosetting resin. In particular, said ink-fixing layer is free from carbonates and alkaline buffers.

The ink-fixing layer according to the invention may contain coating fillers that are chosen essentially from silicas. Preferably, the silicas are essentially precipitated amorphous silicas having a specific surface area greater than 100 $m^2/g$.

In the particular case of the invention where the coating fillers of the ink-fixing layer are transparent or translucent, in particular amorphous silicas, said sheet of base paper can be colored in mass and/or in surface; the coloration remaining visible through said layer considering its transparency after lamination.

The quantity of ink-fixing layer deposited on at least one of the faces of said sheet of base decor paper can be comprised between 4 and 20 $g/m^2$, in particular between 6 and 15 $g/m^2$, by dry weight.

The curtain coating technique is a pre-metered coating method that has been used in the photographic industry for more than twenty years. This technology has been developed for photographic films which require the deposition of many different layers, generally between 8 and 10.

The curtain coating process is based on the free flow onto a surface from a coating head situated above the surface to be coated at a height varying between 10 and 25 cm.

The coating head is defined according to the properties of the coating fluid, so as to obtain the most uniform possible coating film thickness in the running direction or the transverse direction of the machine.

Two types of coating heads are usually used: heads with slits and heads with a sliding surface.

Another advantage of curtain coating is the lack of contact between the coating head and the support, unlike blade coating in particular.

Pre-metering of the quantity of material to be deposited and the total absence of contact, therefore of mechanical stresses, during this deposit allow the sheet of decorative paper to be coated more easily at industrial coating speeds, particularly at speeds above 400 m/min.

In addition, the Applicant has ascertained that since the layer is deposited without pressure, penetration of the composition into the support is limited to simple capillarity of the fibers of the sheet and is therefore minimal. It follows that there is an almost total preservation of the resin-absorption capacity of the sheet, in particular on the uncoated face normally used as the contact face during impregnation with resin.

The invention also relates to a process for producing printed decorative paper that can be impregnated with a thermosetting resin comprising a step for printing, in particular with decorative pattern, said printable sheet of decor paper coated with at least one ink-fixing layer coming from the second step (step b) of the previously described process. In particular, the process for producing a printed decorative paper that can be impregnated with a thermosetting resin for a high- or low-pressure decorative laminate, is characterized in that said ink-fixing layer of the decorative paper obtained following step b is printed by ink jet printing, in particular at a high resolution.

So, the invention also relates to a decorative paper printed by ink jet printing and that can be impregnated with a thermosetting resin, obtained according to this particular case of the process of the invention.

DESCRIPTION OF PARTICULAR EMBODIMENTS

According to the invention, the decorative paper for laminate obtained by the process of the invention as previously described has the property of being printable, namely by ink jet printing, while preserving good properties for absorbing thermosetting resin.

Indeed, the printable or printed decorative paper for laminate, in particular by ink jet printing, and that can be impregnated with a thermosetting resin coming from the processes previously described, is characterized by a speed of impregnation of said resin, determined according to the test described hereinafter in the paragraph "DESCRIPTION OF TESTS AND CONDITIONS FOR PERFORMING SAME", of less than 100 seconds, preferably less than or equal to 65 seconds, whatever its face.

In particular, said speed of impregnation of the decorative paper according to the invention is comprised between 40 and 60 seconds.

As previously described, during the production of laminates, the decor paper is generally first of all printed, then impregnated with a heat-stable thermosetting resin, and finally hot-pressed with its substrate at a high or low pressure.

Consequently, the invention also relates to a process for producing a decorative paper impregnated with a thermosetting resin, which is characterized in that a decorative paper printed, in particular by ink jet printing, obtained according to the process such as previously described, is impregnated with said thermosetting resin.

In particular, the thermosetting resin is chosen from melamine-formaldehyde resins, urea-formaldehyde resins, benzoguanamine-formaldehyde resins, unsaturated polyester resins and mixtures thereof.

Once impregnated with resin, the decorative paper is heated, the resin is partially cured (thermoset) so that it is no longer in an adhesive state and the sheet can be handled. A decorative paper impregnated with partially cured resin is called, in professional terms, "a decor film" or "a decorative film" or "a melamine-treated film". This melamine-treated film contains an amount of resin that preferably lies between 50 and 55% but which can reach 45 to 65%.

This step is usually carried out by raising the decorative paper to temperatures of around 110 to 140° C. and is checked by measuring the amount of volatiles remaining in the decor film so that the resin flows correctly into the sheet during final lamination of the decor film. Indeed, this decor film then contains a certain percentage, of the order of 5 to 8%, of volatile products (water for dissolving the resin, water resulting from chemical condensation of the resin, residual formaldehyde, other residual products, etc. . . . ). These volatiles represent the compounds that will be eliminated during total curing of the resin, during lamination of the decor film.

Once the resin has been totally thermoset after lamination, it will provide the final laminate with surface strength (abrasion resistance, resistance to soiling, water vapor and chemical agents such as solvents, acids and bases, etc.). According to a particular case of the process for producing decorative paper impregnated with resin, a decorative paper having a non-alkaline ink-fixing layer and obtained according to the process for producing printed decorative paper previously described, is impregnated with a thermosetting resin, and said resin is then partially cured in an acid medium, the amount of volatile compounds being comprised between 5 and 8% by weight of the sheet.

The invention finally relates to a laminated decorative panel or profile, which is characterized in that it comprises, as a decorative paper, a decorative paper obtained such as previously described.

In the case of a laminate called a high-pressure laminate, the base components of the laminate are kraft sheets impregnated with thermosetting resin and the decorative paper obtained according to the process of the invention impregnated with a thermosetting resin.

In the case of a low-pressure laminate, the base components of the laminate are the supporting panel such as a panel of agglomerated particles and a decorative paper obtained according to the process of the invention impregnated with a thermosetting resin.

The following non limiting examples will enable the invention to be better understood.

EXAMPLES OF EMBODIMENTS

Comparative Example 1

According to a usual paper-making process, a plain white decorative paper, well smoothed, having a grammage of 80 g/m$^2$, a Gurley porosity of 20 s, a Bekk smoothness of 20 s and an ash content of 38%, was produced. Such a paper is marketed by company Arjowiggins under the trade name Arjosave. This paper was printed as it was by ink jet printing on an Epson® 7600 printer. Next, it was impregnated with a melamine-formaldehyde thermosetting resin and laminated to form a laminated panel of the low-pressure type.

Comparative Example 2

This same Arjosave plain white decorative paper was coated by the blade coating process with 10 g/m$^2$ by dry weight of a layer C1 composed of 28.6 parts of a binder made of a mixture of an aqueous solution of hydrophilic polyvinyl alcohol (PVA) and a polyvinyl acetate in stabilized aqueous dispersion (called latex), in proportions of 85/15 by dry weight respectively, and 100 parts of a coating precipitated calcium carbonate (PCC). This paper was printed by ink jet printing on an Epson® 7600 printer. It was then, as in example 1, impregnated with a melamine-formaldehyde thermosetting resin and laminated to form a low-pressure laminated panel.

Comparative Example 3

This same Arjosave paper was coated by the blade process with 10 g/m$^2$ by dry weight of a layer C2 composed of 28.6 parts of the binder of example 2 and 100 parts of a coating silica (amorphous) having a mean particle size of 5.3-6.3 μm and a specific surface area (BET) of 160 m$^2$/g. This paper, was then, as in the previous examples, printed by ink jet printing on an Epson® 7600 printer. It was then impregnated with a melamine-formaldehyde thermosetting resin and laminated to form a low-pressure laminated panel.

Example 4 According to the Invention

A sheet of this same white plain white paper marketed by the company Arjowiggins under the trade name Arjosave was produced on a paper-making machine of the Fourdrinier type. The sheet, after drying, had a grammage of 80 g/m$^2$, a Gurley porosity of 20 s, a Bekk smoothness of 20 s and an ash content of 38%.

The sheet of paper thus obtained was reeled up.

In a second step, this paper is then coated by the curtain coating process on one of its faces with 10 g/m$^2$ by dry weight of a layer C2 identical to the one used in example 3.

The sheet of paper thus coated was printed by ink, jet printing on an Epson® 7600 printer.

The sheet was then impregnated with a melamine-formaldehyde resin in an aqueous medium.

This sheet was laminated to produce a low-pressure laminate according to the usual operating conditions.

Comparative Example 5

Reference Printing Base

According to usual paper-making process, an unsmoothed plain white decorative paper was produced having a grammage of 80 g/m$^2$, a Gurley porosity of 20 s, a Bekk smoothness of 140 s and an ash content of 38%. Such a paper is marketed by the company Arjowiggins under the trade name Arjoprint. This paper is printed by ink jet printing on an Epson® 7600 printer. Next, it was, as in the previous examples, impregnated with a melamine-formaldehyde thermosetting resin and laminated to form a laminated panel of the low-pressure type.

Comparative Example 6

This same Arjoprint paper is coated according to the blade process with 10 g/M$^2$ of the C2 layer identical to that used in example 3. It was then, as in example 5, printed and then impregnated with a melamine-formaldehyde thermosetting resin and laminated to form a low-pressure laminated panel.

Example 7 According to the Invention

A sheet of this same plain white paper marketed by the company Arjowiggins under the trade name Arjoprint was produced on a paper machine of the Fourdrinier type. The sheet, after drying, had a grammage of 80 g/m$^2$, a Gurley porosity of 20 s, a Bekk smoothness of 140 s and an ash content of 38%.

The sheet of paper thus obtained was reeled up.

In a second step, the paper is coated by the curtain coating process on one of its faces with 10 g/m$^2$ by dry weight of a layer C2 identical to the one used in example 3.

The sheet of paper thus coated is printed by ink jet printing on an Epson® 7600 printer.

The sheet is then impregnated with a melamine-formaldehyde resin in an aqueous medium.

This sheet is laminated to produce a low-pressure laminate under the usual operating conditions.

Comparative Example 8

This same Arjoprint paper is coated according to the blade process with 10 g/m$^2$ of a layer C3 composed of 28.6 parts of a polyvinyl acetate in the form of a latex and 100 parts of a coating silica (amorphous) having a mean particle size of 5.3-6.3 μm and a BET specific surface area of 160 m$^2$/g. It is, as in example 6, printed and then impregnated with a melamine-formaldehyde thermosetting resin and laminated to form a low-pressure laminated panel.

The papers according to these examples were tested according to the tests described hereinafter and the results are given in table 1.

Results:

As can be seen in table 1, all the coated papers—represented by comparative examples 2, 3, 6 and 8 and examples 4 and 7 according to the invention—exhibited a very appreciable increase in ink intensity compared with the reference uncoated decorative papers, represented by example 1 in the case of a smoothed paper and by example 5 in the case of an unsmoothed paper.

It may be ascertained in view of the results given in table 1 that comparative examples 2, 3, 6 and 8 of coated papers had a very different performance from that of comparative examples 1 and 5 of reference uncoated papers in terms of resin-absorbtion capacity.

It should be noted that among all the coating tests, comparative example 2 exhibits a high degree of undercuring of the melamine-formaldehyde resin after lamination.

From example 8, it will be noted that the use of a layer of which the binder contained too much of non-hydrophilic binder (latex) resulted in a blistering phenomenon for the laminate, which is unacceptable.

The examples show that the invention makes it possible to obtain a decorative paper exhibiting at the same time an excellent aptitude for ink jet printing and good resin absorption, necessary for the subsequent impregnation of this type of paper.

The results of these tests show in addition that decorative papers derived from the process for producing decorative paper according to the invention (examples 4 and 7) carried out on a smoothed Arjosave substrate as well on a unsmoothed Arjoprint substrate, have at the same time a good aptitude for ink jet printing and good resin absorption according to the test described hereinafter.

In addition, the use of a non-hydrophilic polymer (of the latex type) mixed with a hydrophilic binder in the coating composition also proved to be possible, in proportions compatible with the requirements for impregnation and lamination of the coated sheet (absence of blistering).

Description of Tests and Conditions for Performing Same:

The grammage of the sheets was determined according to ISO standard 536 after conditioning according to ISO standard 187. It consisted of the grammage of the sheet treated with said pigmented composition but before impregnation with resin.

The air permeability, Gurley porosity method, was determined according to ISO standard 5636-5R (1990).

The impregnation speed is characterized by determining the time of penetration of the thermosetting resin through the sheet, this time being determined in the following manner:

a 56% by weight resin solution is prepared by dissolving the melamine-formaldehyde resin Madurit MW550 in powder form in distilled water heated to 45° C. The viscosity is adjusted so that it is of the order of 100 mPas (cps) at 20° C. on a Brookfield viscometer measured at 100 revolutions/min—shaft N°2, the impregnation time of a sheet of paper is determined as follows:

two square (10×10 cm) samples are cut out per test; for testing each face, the face is referenced, a watch-glass is filled with resin, the paper square is deposited on the surface of the resin, with the face to be tested in contact therewith, and the chronometer is started at the same time, the total strike-through time is noted which gives the penetration time of the resin.

The following tests were carried out on a particle panel onto which the decor film (sheet impregnated with resin) had been laminated:

The graphite test was carried out as follows: powdered graphite was mixed with oil so as to form a paste. This paste was spread over the visible face of the decor film. The panel was then cleaned with a damp sponge impregnated with a detergent. The cleaned surface was compared with a reference scale. The scale extended from 1 to 6, the lowest score being 1.

This graphite test made it possible to assess the porosity of the decor film after lamination and therefore its resistance to soiling. This property depends on several parameters including the degree of volatiles in the resin, the lamination, the decorative sheet.

TABLE 1

| | | | Resin impregnation | Lamination | | |
|---|---|---|---|---|---|---|
| | Coating process | Printing reproduction | Total strike-through (seconds): coated face/uncoated face | Porosity (graphite test) | Curing of resin (° C.) | Observations Appearance of panel |
| Comparative example 1 | — | Very pale | 8/6 | 3.5 | 3 | Good |
| Comparative example 2 | Blade | Good | >240/15 | 4 | 4.5 | Matt |
| Comparative example 3 | Blade | Good | >240/13 | 4.5 | 2.5 | Good |
| Invention Example 4 | Curtain | Good | 65/7 | 4 | 2.5 | Good |
| Comparative example 5 | — | Very pale | 6/6 | 4.5 | 3 | Good |
| Comparative example 6 | Blade | Good | >240/10 | 5 | 2.5 | Good |
| Invention Example 7 | Curtain | Good | 40/8 | 4 | 2.5 | Good |
| Comparative example 8 | Blade | Good | >240/13 | 4 | 2.5 | Quite a number of blisters |

The invention claimed is:

1. A process of producing a decorative paper coated with at least one ink-fixing layer, printable by ink jet printing and capable of being impregnated with a thermosetting resin, for a high- or low-pressure decorative laminate, comprising:

a. producing a sheet of base decor paper by paper making route, then b. coating at least one of the faces of said sheet of base decor paper by curtain coating with at least said ink-fixing layer, the coated paper sheet having a resin-impregnation speed of less than 100 seconds whatever its face.

2. The process as claimed in claim 1, wherein the layer is not alkaline.

3. The process as claimed in claim 2, wherein the layer is free from carbonates and alkaline buffers.

4. The process as claimed in claim 1, wherein the layer contains coating fillers chosen substantially from silicas.

5. The process as claimed in claim 4, wherein said silicas are essentially precipitated amorphous silicas.

6. The process as claimed in claim 1, wherein the quantity of layer deposited is comprised between 4 and 20 g/m$^2$, in particular between 6 and 15 g/m$^2$ by dry weight.

7. The process as claimed in claim 1, wherein said process includes a printing step of the paper sheet coated with at least one ink-fixing layer coming from step b of said process.

8. The process as claimed in claim 7, wherein said ink-fixing layer is printed by ink jet printing.

9. The process as claimed in claim 7, wherein the printing step of the paper sheet coated with at least one ink-fixing layer coming from step b of said process includes printing of a decorative pattern.

10. The process as claimed in claim 1, wherein the sheet of base decor paper has a Bekk smoothness of 20 to 140 seconds before being coated.

11. The process as claimed in claim 1, wherein the ink-fixing layer contains at least one hydrophilic binder.

12. The process as claimed in claim 11, wherein said layer contains, in addition to said hydrophilic binder, a non-hydrophilic polymeric binder in a ratio of hydrophilic binder/non-hydrophilic binder of at least 70/30 by dry weight.

13. The process as claimed in claim 11, wherein the hydrophilic binder is a polyvinyl alcohol (PVA).

14. The process as claimed in claim 1, wherein the coated paper sheet has an impregnation speed of from 40 to 60 seconds.

15. A process for producing an impregnated decorative paper for decorative laminates, comprising impregnating a printed decorative paper obtained by the process as claimed in claim 7 with a thermosetting resin.

16. The process as claimed in claim 15, wherein the thermosetting resin is chosen from melamine-formaldehyde resins, urea-formaldehyde resins, benzoguanamine-formaldehyde resins, unsaturated polyester resins and mixtures thereof.

17. A process of impregnating a coated paper sheet for a decorative paper for use in a high- or low-pressure decorative laminate, comprising:

impregnating at least one face of a sheet of coated base decor paper with a thermosetting resin, wherein at least one of the faces of said sheet of base decor paper is coated with at least one ink-fixing layer, the coated paper sheet being printable by inkjet printing and having a resin-impregnation speed of less than 100 seconds whatever its face.

* * * * *